US008553060B2

(12) United States Patent
Miyashita et al.

(10) Patent No.: US 8,553,060 B2
(45) Date of Patent: Oct. 8, 2013

(54) THERMAL PRINTER

(75) Inventors: Shinichi Miyashita, Fujiyoshida (JP); Kohzoh Abe, Tokyo (JP)

(73) Assignee: Citizen Systems Japan Co., Ltd., Tokyo (JP)

( * ) Notice: Subject to any disclaimer, the term of this patent is extended or adjusted under 35 U.S.C. 154(b) by 645 days.

(21) Appl. No.: 12/682,949

(22) PCT Filed: Sep. 8, 2008

(86) PCT No.: PCT/JP2008/066184

§ 371 (c)(1),
(2), (4) Date: Apr. 14, 2010

(87) PCT Pub. No.: WO2009/054195

PCT Pub. Date: Apr. 30, 2009

(65) Prior Publication Data

US 2010/0245522 A1 Sep. 30, 2010

(30) Foreign Application Priority Data

Oct. 24, 2007 (JP) ..... 2007-276616

(51) Int. Cl.
*B41J 11/00* (2006.01)

(52) U.S. Cl.
USPC ..... 347/220

(58) Field of Classification Search
USPC ..... 347/220, 222, 197, 198; 400/619, 400/644
See application file for complete search history.

(56) References Cited

U.S. PATENT DOCUMENTS

| | | | |
|---|---|---|---|
| 2002/0021927 | A1 | 2/2002 | Mori et al. |
| 2008/0019757 | A1 | 1/2008 | Watanabe |

FOREIGN PATENT DOCUMENTS

| | | |
|---|---|---|
| JP | 6-47991 | 2/1994 |
| JP | 7-237324 | 9/1995 |
| JP | 9-234922 | 9/1997 |
| JP | 2002-120389 | 4/2002 |
| JP | 2003-287995 | 10/2003 |
| JP | 2005-74885 | 3/2005 |
| JP | 2005-119108 | 5/2005 |
| JP | 2005-119700 | 5/2005 |
| JP | 2005-238658 | 9/2005 |

*Primary Examiner* — Kristal Feggins
(74) *Attorney, Agent, or Firm* — Smith, Gambrell & Russell, LLP

(57) ABSTRACT

A head unit (4), a platen roller (3), a motor (5) and a gear transmission mechanism (6) are attached to a frame (2) of a thermal printer. The frame (2) is molded by die-casting an alloy material, and a radiating fin assembly (15) is formed integral with the frame (2) in the vicinity of a motor mounting area of the frame (2). Heat generated from the motor (5) is radiated from the die-cast frame and the radiating fin assembly.

7 Claims, 2 Drawing Sheets

THERMAL PRINTER

TECHNICAL FIELD

The present invention relates to a heat radiation structure of a thermal printer.

BACKGROUND ART

Since a motor for driving a printer that uses a platen roller as sheet conveying means generates heat, various heat radiation countermeasures have been proposed. In a small printer that utilizes a thermal head, in particular, a frame that is frequently used for heat radiation is small in size and heat capacity, and components are located so close to one another that the heat radiation environment is poor. In addition, heat is also radiated from a heat unit, and a thermal influence on a head must be taken into consideration. Thus, a heat radiation countermeasure for the motor is an essential factor.

Thermal printers with a heating structure are generally known, as described in Japanese Patent Application Laid-Open Nos. 7-0237324 and 2005-238658, for example.

In the thermal printer described in the above Japanese Patent Application Laid-Open No. 7-0237324, a driving force transmission mechanism for transmitting a decelerated rotation of a motor is configured by fixing a gear mounting member to the inside of an aluminum box member formed by bending an aluminum plate. A mounting flange of the motor is mounted on one outside surface of the aluminum box member so that heat generated from the motor can be radiated through the box member in close contact with the flange, thereby suppressing an increase in temperature of the motor.

However, the aluminum box member has so small a heat capacity that it is inevitably thermally saturated in a short time. Therefore, heat release from the motor balances with heat radiation from the box member at too high a temperature to ensure a satisfactory heat radiation effect.

In the thermal printer described in the above Japanese Patent Application Laid-Open No. 2005-238658, on the other hand, a drive unit that includes a motor mounted on a gear mounting member is attached to one side wall of a mainframe that supports a platen roller. Since the gear mounting member on which the motor is mounted is formed by die-cast working with zinc alloy, heat generated from the motor can be radiated through the gear mounting member.

Since the gear mounting member is a die-cast product of an alloy material, its heat radiation effect is higher than that of the aforesaid aluminum box member. Since the gear mounting member is a small member that is attached to the one side wall of the mainframe, however, a very high heat radiation effect cannot be expected of it. In addition, the gear mounting member is not positively designed to improve such radiation, in addition to forming it by die-cast working.

DISCLOSURE OF THE INVENTION

Accordingly, the object of the present invention is to provide a thermal printer including a platen roller as sheet conveying means and configured so that heat from a motor can be fully radiated with high efficiency.

A thermal printer according to the present invention comprises: a thermal head which alternatively heats a plurality of heating elements arranged in a straight line and prints a recording sheet; a platen roller which holds the recording sheet between the platen roller and the thermal head and conveys the sheet; a motor for driving the platen roller; a gear transmission mechanism for transmitting a driving force of the motor to the platen roller; and a frame to be fitted with the thermal head, the platen roller, the motor, and the gear transmission mechanism. Further, in order to solve the above problem, the frame is molded by die-casting an alloy material, and that part of the die-cast frame on which the motor is to be mounted is formed with a radiating fin assembly integral with the frame.

The radiating fin assembly may be formed on a wall surface of the frame behind the wall surface on which the motor is mounted.

The frame may be an integral molded product including left and right side walls and a connecting portion which connects these side walls, and the radiating fin assembly is formed on an outer wall surface of the left or right side wall.

The radiating fin assembly may include a plurality of fins arranged parallel to one another at predetermined intervals, and vertically extending grooves may be formed individually between the fins. Respective upper and lower ends of the grooves formed between the fins may be open.

The height of projection of the radiating fin assembly from a wall surface of the frame may be greater than a wall thickness of the frame on which the motor is mounted.

According to the thermal printer of the present invention constructed in this manner, the heat capacity of those members which are thermally associated with heat generated from the motor is increased and the heat radiation area is enlarged, so that the heat radiation effect is improved.

BEST MODE FOR CARRYING OUT THE INVENTION

Figure 1:
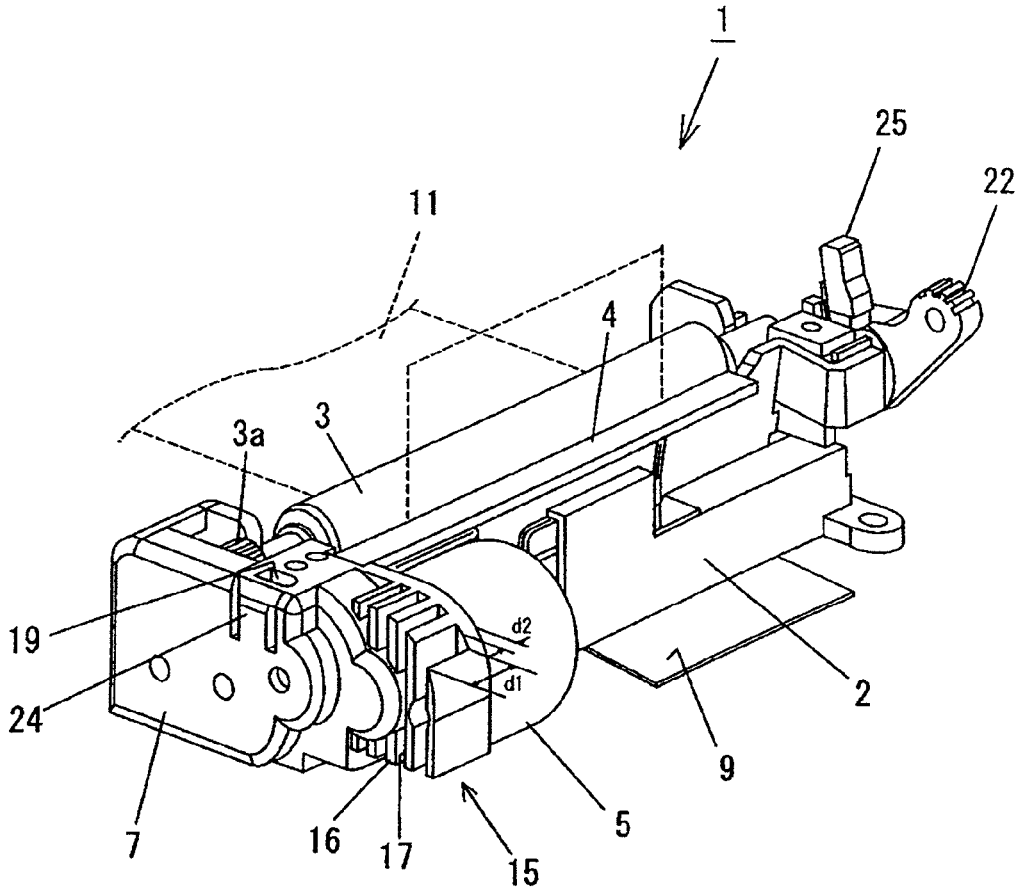
FIG. 1 shows a printing mechanism section of a thermal printer according to one embodiment of the present invention.

A printing mechanism section 1 of a thermal printer according to one embodiment of the present invention will be described with reference to FIGS. 1 and 2.

The printing mechanism section 1 is composed of a frame 2, a platen roller 3, a head unit 4 provided with a thermal head, a motor 5, and a gear transmission mechanism 6. Mounted around the printing mechanism section 1, moreover, are a gear cover 7, a guide plate 8, a flexible printed circuit board (FPC) 9, and a head pressing spring 10. All these members except the frame 2 have the same configurations and functions as the conventional ones. The drive of the motor 5 is controlled by a controller (not shown) that is incorporated in the thermal printer. The controller further transmits a print signal to the head unit 4 through the FPC 9.

In this embodiment, the frame 2 is a die-cast member of aluminum alloy. The platen roller 3, head unit 4, gear transmission mechanism 6, etc., are assembled to the frame 2 to constitute the printing mechanism section 1. The frame 2 is an integral structure that is composed of a left side wall 12, a right side wall 13, and a connecting portion 14 connecting these walls 12, 13. The left and right side walls 12 and 13 are located on the left and right sides, respectively, of a paper sheet 11 that is fed by the platen roller 3. The connecting portion 14 is elongated parallel to the axis of the platen roller.

Figure 2:
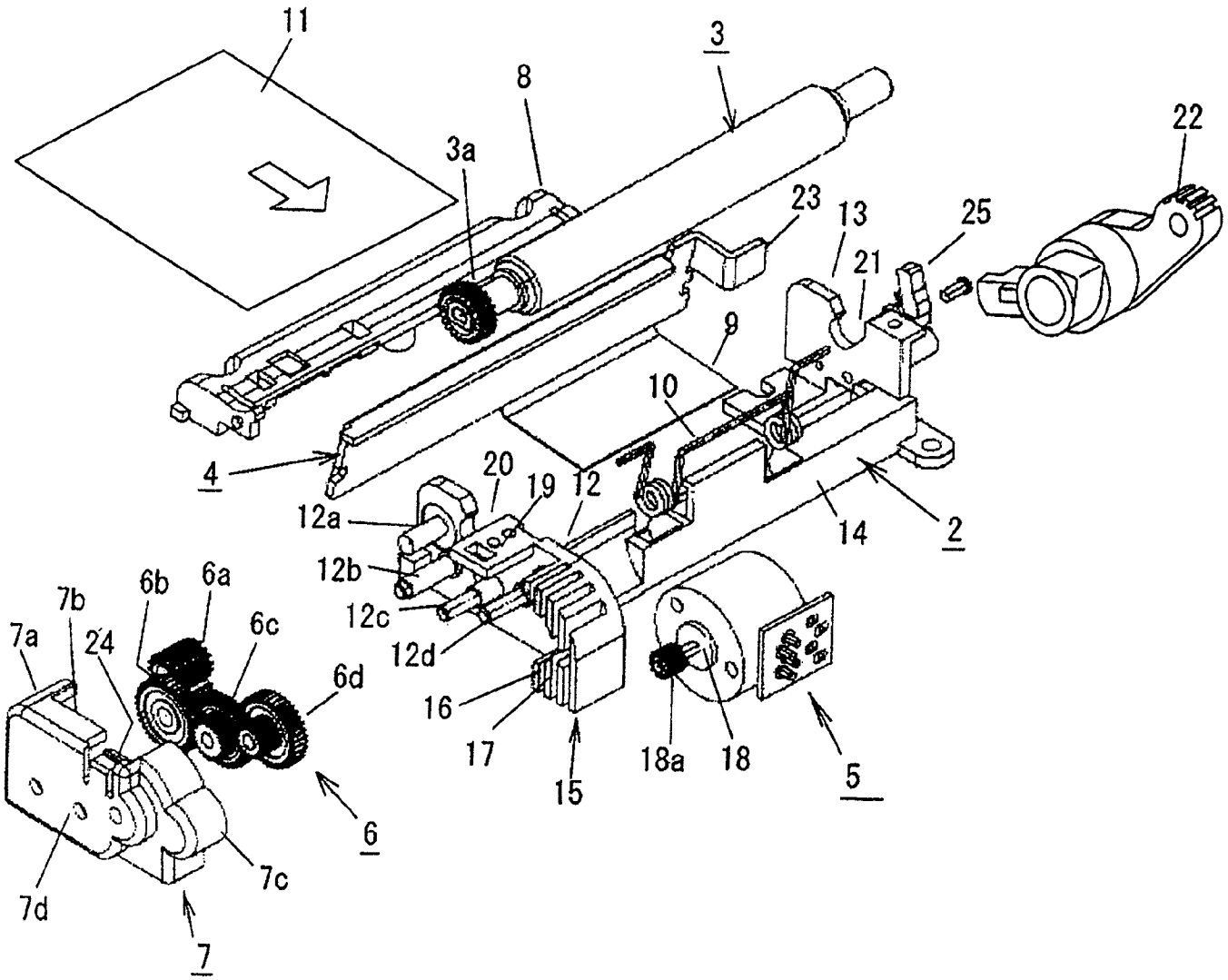
FIG. 2 is an exploded perspective view of the printing mechanism section of FIG. 1.

As shown in FIG. 2, a plurality of gear shafts 12*a* to 12*d* are formed on the front end portion (upstream part with respect to the feed direction of the paper sheet 11) of the outside surface of the left side wall 12 of the frame 2, while a radiating fin assembly 15 is formed on the rear end portion (downstream part with respect to the paper feed direction). The gear shafts 12*a* to 12*d*, formed integral with the left side wall 12, protrude integrally outward from the left side wall 12 and support gears 6*a* to 6*d*, respectively, which constitute the gear transmission mechanism 6. The radiating fin assembly 15, formed integral with the left side wall 12, also protrudes integrally outward from the left side wall 12.

Further, the radiating fin assembly 15 includes a plurality of fins 16 that are arranged parallel to one another at predetermined intervals. Vertical grooves 17 are formed individually between the fins 16. Both the upper and lower ends of each groove 17 are open. As shown in FIG. 1, a height d1 of outward projection of each fin 16 from the left side wall 12 is greater than a thickness d2 of the left side wall 12. In this embodiment, the height d1 is about three times as great as the thickness d2 (d1≈3×d2).

The motor 5 is mounted on a motor mounting area at the rear end portion of the inside surface of the left side wall 12 of the frame 2. The rear end portion of the left side wall 12, including the motor mounting area, is formed with a through-hole (not shown) and threaded holes (not shown). The through-hole allows an output shaft 18 of the motor 5 and an output gear 18*a* mounted on its distal end to penetrate the left side wall 12 from the inside surface to the outside. The threaded holes are used in fixing the motor 5 to the inside surface of the left side wall 12.

Further, a lug receiving portion 19 protrudes horizontally outward from the central part of the upper end of the left side wall 12. Also, a left bearing groove 20 that receives a left-side shaft portion of the platen roller 3 is formed in the front end portion of the upper end of the left side wall 12, while a right bearing groove 21 that receives a right-side shaft portion of the roller 3 is formed in the central part the upper end of the right side wall 13. Furthermore, a head-up lever 22 is attached to the outside surface of the right side wall 13 so that it can be positioned longitudinally. Reference numeral 25 denotes a switch for detecting the presence/absence of the platen roller 3.

The platen roller 3 has the shaft portions protruding from its left and right ends, individually, and a driven gear 3*a* is mounted on the left-side shaft portion.

The head unit 4 is formed of a flat plate-like member that is elongated transversely, and the left and right ends of the plate-like member are supported by the left and right side walls 12 and 13, respectively. A hook-like receiving piece 23 integrally protrudes from the right end portion of the plate-like member that constitutes the head unit 4. As shown in FIG. 2, the receiving piece 23 forwardly projects for a certain distance and is then bent outward. A thermal head (not shown) is attached to the front surface of the plate-like member that constitutes the head unit 4 so as to extend along the platen roller 3.

The gear transmission mechanism 6, driven gear 3*a*, and output gear 18*a* are disposed on the outside surface of the left side wall 12 of the frame 2. The driven gear 3*a* is mounted on the left-side shaft portion of the platen roller 3 so as to be in mesh with the gear transmission mechanism 6. The output gear 18*a* is fixed to the distal end of the output shaft of the motor 5. The gear transmission mechanism 6, the driven gear 3*a* and the output gear 18*a* are covered by the gear cover 7. The gear cover 7 is composed of a front surface 7*a*, top surface 7*b*, rear surface 7*c*, and side surface 7*d*. A part of the upper surface 7*b* forms an engaging lug 24. Further, the rear surface 7*c* is configured such that an arcuate portion covering regions near the respective outer peripheries of the gear transmission mechanism 6 and another arcuate portion covering the output gear 18*a* of the motor 5 are continuous with each other.

The radiating fin assembly 15 that protrudes outward from the outside surface of the left side wall 12 is cut so as to fit the form (including the coupled arcuate portions) of the rear surface 7*c* of the gear cover 7. Thus, the rear surface 7*c* of the gear cover 7 can get into the cut portion of the radiating fin assembly 15 and directly contact the outside surface of the left side wall 12 without being hindered by the fin assembly.

The printing mechanism section 1 is assembled in the following manner. First, the head unit 4 is attached to the frame 2 (FIG. 1). The guide plate 8 is attached to the frame 2 from the front. The head pressing spring 10 is attached to the frame 2. Then, the platen roller 3 is attached to the frame 2 with the head-up lever 22 positioned on its head-up side. If the head-up lever 22 is thus rotated to the head-up side, a projection (not shown) formed on the proximal part of the head-up lever 22 engages with the receiving piece 23 of the head unit 4, thereby rocking the head unit 4. Thereupon, the head unit 4 is disengaged from the platen roller 3 and exposed. The shaft portions of the platen roller 3 on its left and right ends are fitted into left and right bearing grooves 20 and 21 in the left and right side walls 12 and 13, respectively. Thus, the platen roller 3 is removably set on the frame 2. When the platen roller 3 is thus set on the frame 2, the platen presence detection switch 25 is turned on. If the head-up lever 22 is restored to its set position, the head unit 4 is pressed toward the platen roller 3 by the head pressing spring 10, whereupon the printer is ready to start printing.

After the gears 6*a* to 6*d* that constitute the gear transmission mechanism 6 are then fitted, respectively, into the gear shafts 12*a* to 12*d* that are formed integrally on the outside surface of the left side wall 12 of the frame 2, the motor 5 is screwed to the inside surface of the left side wall 12. The output gear 18*a* fixed on the distal end of the output shaft 18 of the motor 5 that is fixed to the left side wall 12 penetrates a through-hole (not shown) in the left side wall 12 from inside to outside and meshes with the first gear 6*d* that constitutes the gear transmission mechanism 6. Further, the driven gear 3*a* mounted on the left-side shaft portion of the platen roller 3 that is attached to the frame 2 meshes with the fourth gear 6*a* that constitutes the gear transmission mechanism 6. The gear cover 7 is attached to the frame 2 so as to contain therein the gear transmission mechanism 6 (gears 6*a* to 6*d*) and the output gear 18*a* (in mesh with the gear 6*d*) of the motor 5. When the gear cover 7 is attached to the frame 2, the engaging lug 24 on its upper surface 7*b* engages with the lug receiving portion 19 of the left side wall 12 of the frame 2.

As mentioned before, the motor 5 is mounted on the motor mounting area on the inside surface of the left side wall 12 of the frame 2. On the other hand, the radiating fin assembly 15 is formed on that one of the left and right side walls 12 and 13 of the frame 2 which is fitted with at least the motor 5. In the example shown in FIGS. 1 and 2, the radiating fin assembly 15 is formed in its corresponding position on that surface (outside surface) just behind the motor mounting area on the inside surface of the left side wall 12. In addition, the height d1 of projection of each fin 16 of the radiating fin assembly 15 from the left side wall 12 is greater than the thickness d2 of the wall 12. Further, the radiating fin assembly 15 is composed of the fins 16 that are arranged parallel to one another at predetermined intervals. The vertical grooves 17 are formed individually between the fins 16, and both the upper and lower ends of each groove 17 are open.

When the motor 5 is driven, the paper sheet 11 is fed along the guide plate 8 from the front into the gap between the platen roller 3 and the head unit 4 and printed by the thermal head. The printed paper sheet 11 is delivered upward by the platen roller 3. A cover (not shown) is attached to the printing mechanism section 1 so as to entirely cover it and arrange its appearance as a printer.

Heat that is generated as the motor 5 is operated is first absorbed by the left side wall 12 of the frame 2 that includes the motor mounting area, then diffused into the entire frame 2, and radiated from the surface of the frame 2. The frame 2 basically has a large capacity to absorb heat, since it is a member that supports not only the area where the motor 5 is mounted but also the entire printing mechanism section 1. Since the entire frame 2 is a die-cast member of aluminum alloy, moreover, heat propagates and diffuses fast, as compared with a frame made of a stainless-steel or plastic frame. Accordingly, the temperature of the entire frame 2 increases slightly, as a result, heat generation and radiation balance each other at low temperature. In the frame 2, moreover, the radiating fin assembly 15 is formed on the reverse surface (outside surface) of the left side wall 12 behind the motor mounting area. Thus, a heat-radiating surface is enlarged, so that heat can be efficiently radiated near a source of heat generation.

As shown in FIG. 1, the height d1 of projection of each fin 16 of the radiating fin assembly 15 is greater than the thickness d2 of the left side wall 12, so that the heat capacity of the motor mounting area in which the motor 5 is mounted is large. In addition, the grooves 17 between the fins 16 are formed extending vertically with their upper and lower ends open upward and downward, respectively. If the temperature of the frame 2 is increased by the heated motor 5, therefore, an upward air flow is produced between the fins 16 by convection, so that a high cooling effect can be obtained. Since air thus smoothly flows in the radiating fin assembly 15, the heat radiation effect at the motor mounting area of the left side wall 12 in which the motor 5 is mounted is particularly enhanced.

The frame 2, which is an integral structure composed of the left and right side walls 12 and 13 and the connecting portion 14 connecting these walls 12, 13, may be formed of a die-castable metal or alloy with high thermal conductivity as well as aluminum alloy. Preferably, the radiating fin assembly 15 should be situated behind the motor mounting area of the one side wall of the frame, that is, near the mounting position for the motor 5. Basically, however, the radiating fin assembly 15 may be situated in any position near the motor mounting area.

Further, the gear cover 7 that covers the gear transmission mechanism 6, the driven gear 3*a* and the output gear 18*a* is fitted in the cut portion, which is formed by cutting a part of the radiating fin assembly 15 to fit the external shape of the rear surface 7*c* of the gear cover 7, and contacts the left side wall 12. If the gear cover 7 is also formed by die-casting a metal or alloy with high thermal conductivity, therefore, heat can be more efficiently radiated from the motor 5.

The invention claimed is:

1. A thermal printer comprising:

a thermal head which alternatively heats a plurality of heating elements arranged in a straight line and prints a recording sheet;

a platen roller which holds the recording sheet between the platen roller and the thermal head and conveys the sheet;

a motor for driving the platen roller;

a gear transmission mechanism for transmitting a driving force of the motor to the platen roller; and a frame to be fitted with the thermal head, the platen roller, the motor, and the gear transmission mechanism, wherein said frame is molded by die-casting an alloy material, and that part of the die-cast frame on which said motor is to be mounted is formed with a radiating fin assembly integral with the frame.

2. The thermal printer according to claim 1, wherein said radiating fin assembly is formed on a wall surface of the frame behind the wall surface on which the motor is mounted.

3. The thermal printer according to claim 1, wherein said frame is an integral molded product including left and right side walls and a connecting portion which connects these side walls, and said radiating fin assembly is formed on an outer wall surface of the left or right side wall.

4. The thermal printer according to claim 3, wherein said motor is mounted on an inside surface of the side wall on which the radiating fin assembly is formed, said gear transmission mechanism, which includes an output gear mounted on the distal end of an output shaft of the motor and a gear in mesh with the output gear, is located outside the side wall on which the radiating fin assembly is formed, and the output gear and the gear transmission mechanism are covered by a gear cover, at least a part of which is molded by die-casting an alloy material and contacts an outside surface of a side wall on which the motor is mounted through a cut portion in the radiating fin assembly.

5. The thermal printer according to claim 1, wherein said radiating fin assembly includes a plurality of fins arranged parallel to one another at predetermined intervals, and vertically extending grooves are formed individually between the fins.

6. The thermal printer according to claim 5, wherein respective upper and lower ends of said grooves formed between the fins are open.

7. The thermal printer according to claim 1, wherein the height of projection of said radiating fin assembly from a wall surface of the frame is greater than a wall thickness of the frame on which the motor is mounted.

* * * * *